US006011468A

United States Patent [19]

Lee

[11] Patent Number: 6,011,468

[45] Date of Patent: Jan. 4, 2000

[54] GARAGE DOOR ALARM

[75] Inventor: Michael Bing Kong Lee, 364 Casanova Ave., Monterey, Calif. 93940

[73] Assignee: Michael Bing Kong Lee, Monterey, Calif.

[21] Appl. No.: 09/290,208

[22] Filed: Apr. 12, 1999

[51] Int. Cl.[7] ..... G08B 13/08

[52] U.S. Cl. ..... 340/545.1; 340/686.1; 340/539; 49/31

[58] Field of Search ..... 340/545.1, 545.6, 340/686.1, 686.6, 539, 550, 551, 552, 547, 546; 49/31

[56] References Cited

U.S. PATENT DOCUMENTS

| | | | |
|---|---|---|---|
| 4,463,292 | 7/1984 | Engelmann | 318/283 |
| 5,247,232 | 9/1993 | Lin | 318/468 |
| 5,565,843 | 10/1996 | Meyvis | 340/545 |
| 5,689,236 | 11/1997 | Kister | 340/545 |
| 5,841,352 | 11/1998 | Prakash | 340/573.1 |
| 5,883,579 | 3/1999 | Schreiner et al. | 340/686 |

*Primary Examiner*—Jeffery A. Hofsass
*Assistant Examiner*—Anh La
*Attorney, Agent, or Firm*—LaRiviere, Grubman & Payne, LLP

[57] ABSTRACT

The invention provides a garage door opener alarm for a vehicle that is only triggered when the garage door is open and the vehicle is closer to the garage than a first distance, but further from the garage than a second distance. The invention uses a transmitter system connected to a sensor, where the transmitter system works in conjunction with a first receiver with a first effective range and a second receiver with a second effective range, which senses whether or not the garage door is open. The first receiver and second receiver are mounted in the vehicle. An alarm is sounded only if one receiver receives a signal while the other receiver does not receive a signal.

18 Claims, 5 Drawing Sheets

GARAGE DOOR ALARM

FIELD OF THE INVENTION

The present invention relates an alarm to indicate that a door is open. More specifically, the present invention relates to an alarm for a vehicle to indicate that a garage door is open.

BACKGROUND OF THE INVENTION

Automatic garage door openers are used to open and close garage doors. Special safety switches are used in garage door openers to prevent a garage door from closing if the safety switch is triggered. The triggering of a safety switch will cause a closing garage door to fully open, which may result in an open garage door, when the user had thought it was closed. At other times, the user may drive away from a garage door and forget to close it. An open garage door invites theft of items in the garage, and possibly items within the house, and also presents a danger to those remaining in the house.

When a vehicle is in the garage, it is not desirable to have an alarm indicate that the garage door is open, otherwise the user might manually switch off the alarm, or ignore it. Switching off the alarm or ignoring it, will make the user less likely to use the alarm, when the user needs it, such as when the user is driving away and the garage door remains open.

Such alarms are not desirable or useful as long distance alarms, since the user may not desire to know that the garage door is open when the user is a long distance away, since the user would not be able to close the garage door at such a distance. In addition, long distance signals require more power, crowd the bandwidth, and require additional licenses.

BRIEF SUMMARY OF THE INVENTION

It is an object of the invention, to provide a garage door alarm for a vehicle that is triggered only at times where it is important to the user.

It is another object of the invention to provide a garage door alarm that only requires short distance signals.

Accordingly, the foregoing objects are accomplished by a garage door opener alarm for a vehicle that is only triggered when the garage door is open and the vehicle is closer to the garage than a first distance, but further from the garage than a second distance.

Other features of the present invention are disclosed or apparent in the section entitled: "DETAILED DESCRIPTION OF THE INVENTION."

BRIEF DESCRIPTION OF DRAWINGS

For fuller understanding of the present invention, reference is made to the accompanying drawings wherein.

Figure 1:
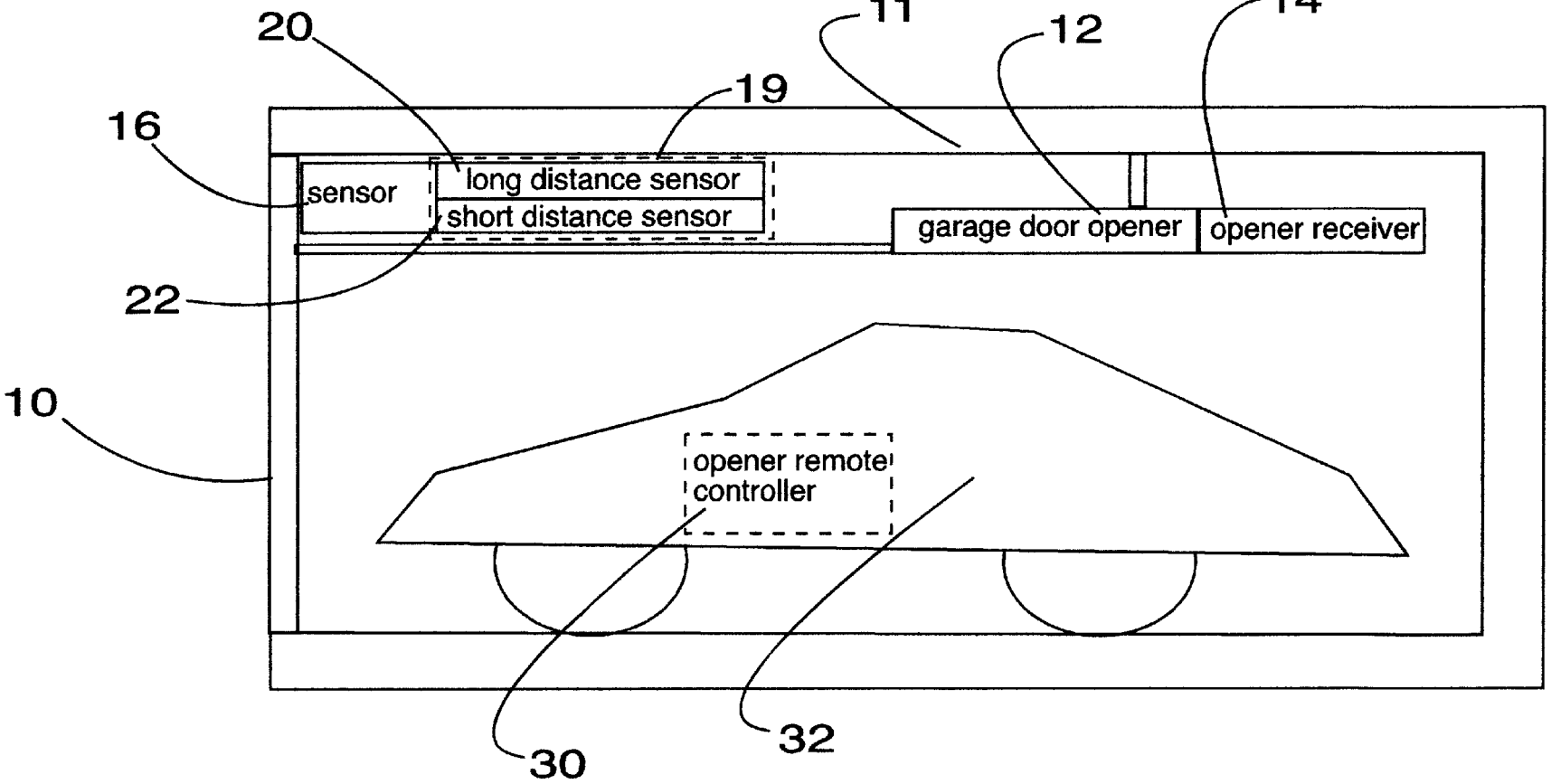
FIG. 1 is a schematic view of a garage door with a garage door opener that uses the invention.

Reference numbers refer to the same or equivalent parts of the present invention throughout the several figures of the drawing.

DETAILED DESCRIPTION OF THE INVENTION

FIG. 1 is a schematic view of a door, which in the preferred embodiment is a garage door 10. A mechanical opener, which in the preferred embodiment is a garage door opener 12, is mechanically connected to the garage door 10, which seals a garage 11. An opener receiver 14 is controllably connected to the garage door opener 12. A controllable connection is an electrical, mechanical or some other connection that allows the receiver 14 to control the garage door opener 12. A sensor 16 is connected to the garage door 10. In the preferred embodiment, the sensor 16 is directly connected to the garage door 10. In other embodiments, the sensor 16 may be indirectly connected to the garage door 10 through the garage door opener 12. The sensor 16 is electrically connected as an input to a transmitter system 19, which comprises a long distance transmitter 20 and a short distance transmitter 22, as shown in FIG. 1. The long distance transmitter 20 transmits a first signal through the air. The short distance transmitter 22 transmits a second signal through the air. The first and second signals could be an electromagnetic signal or a sound wave or another energy transmitting signal. In a preferred embodiment of the invention, the first signal has a first frequency at a first power and first intensity of an electromagnetic radio wave and the second signal has a second frequency, which is lower than the first frequency at a second power which is lower than the first power and a second intensity, which is lower than the first intensity.

Figure 2:
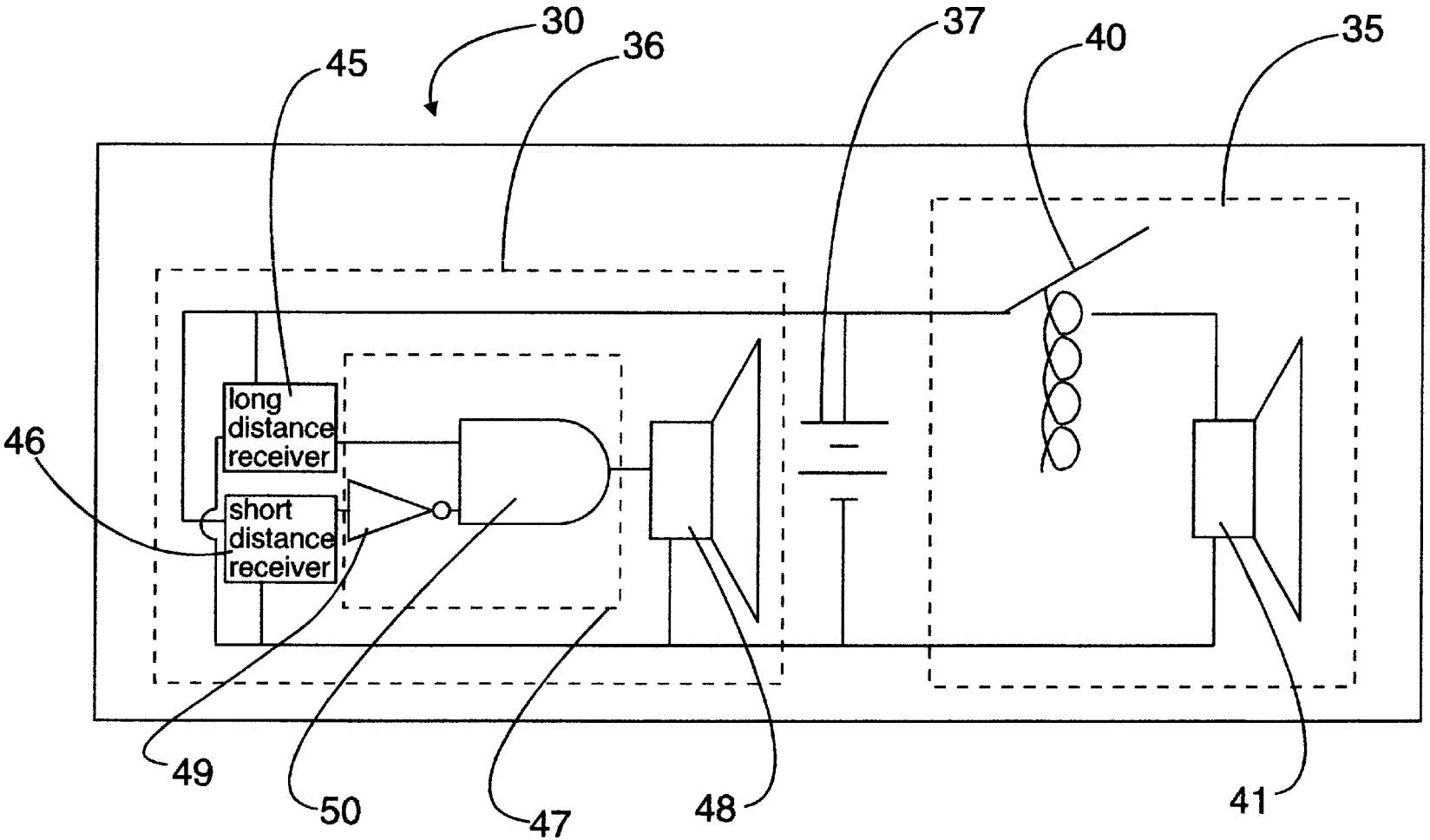
FIG. 2 is an electrical schematic of a receiver illustrated in FIG. 1.

A vehicle 32, such as a car, is parked in the garage 11. An opener remote controller 30 is mounted in the vehicle 32. FIG. 2 is an enlarged electrical schematic view of the opener remote controller 30. The opener remote controller 30 comprises a controller circuit 35, an indicator circuit 36, and a battery 37 electrically connected to the opener circuit 35 and the indicator circuit 36. The controller circuit 35 comprises a spring loaded switch 40 and a remote transmitter 41. The indicator circuit 36 comprises a long distance receiver 45, a short distance receiver 46, a logic device 47 and an alarm system 48. The logic device 47 comprises a NOT gate 49 and an AND gate 50. An output of the short distance receiver 46 provides an input to the NOT gate 49 which provides an output, which is connected to an input of the AND gate 50. An output of the long distance receiver 45 is connected to another input of the AND gate 50. An output of the AND gate is connected to an input of the alarm system 48, as schematically shown in FIG. 2.

Figure 3:
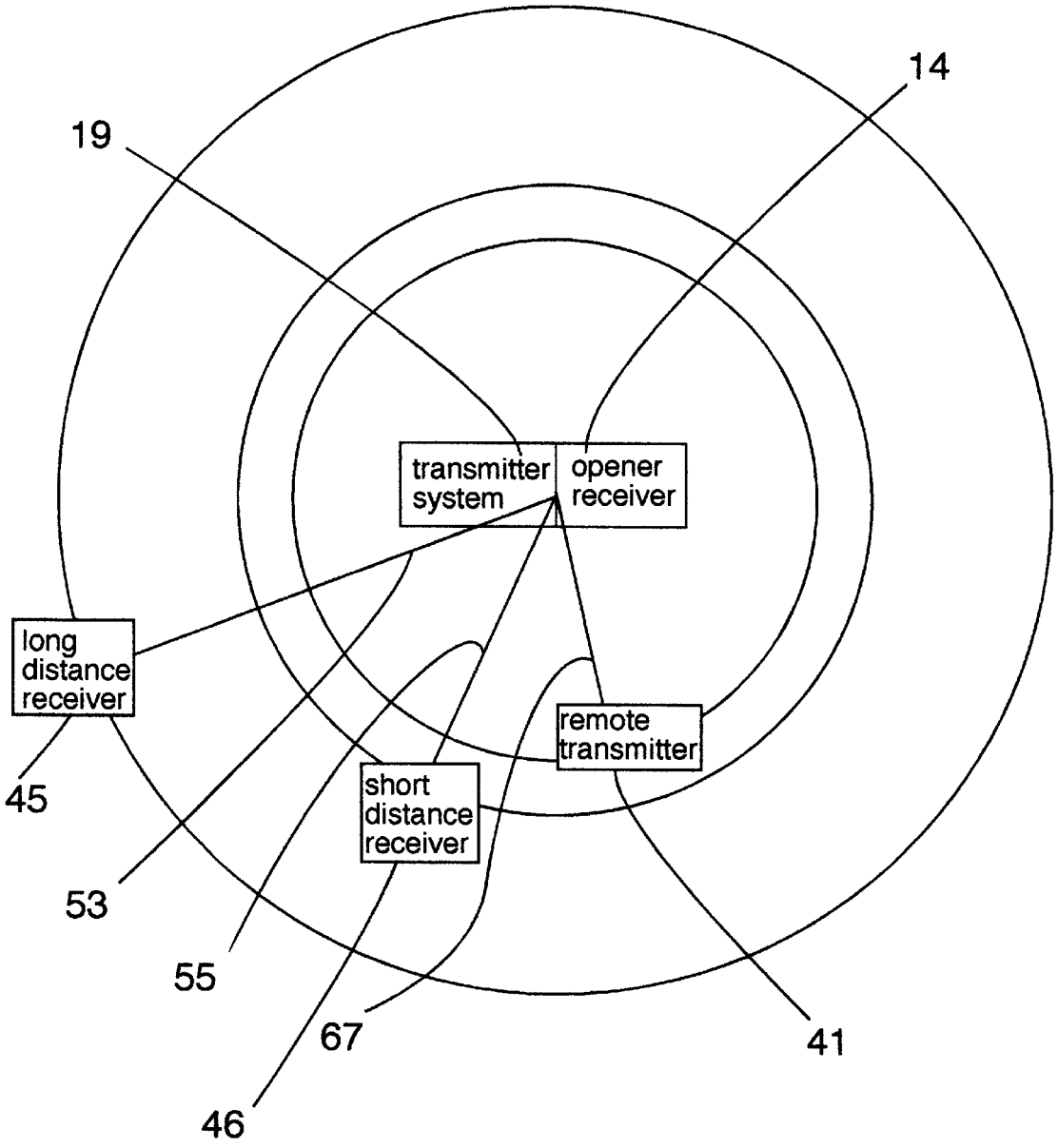
FIG. 3 is a schematic view of a first and second effective range.

FIG. 3 illustrates the effective range 53 of the transmitter system 19 and the long distance receiver 45, which in this embodiment is the effective range between the long distance transmitter 20 and the long distance receiver 45, and illustrates the effective range 55 of the transmitter system 19 and short distance receiver 46, which in this embodiment is the effective range between the short distance transmitter 22 and the short distance receiver 46. The effective range 53 of the transmitter system 19 and long distance receiver 45 is the maximum distance that the long distance receiver 45 may be from the transmitter system 19, which still allows the long distance receiver 45 to receive a sufficient first signal to cause the long distance receiver 45 to send an ON input to the logic gate 47. The effective range 55 of the transmitter system 19 and the short distance receiver 46 is the maximum distance that the transmitter system 19 may be from the short distance receiver 46, which still allows the short distance receiver 46 to receive a sufficient second signal to cause the short distance receiver to send an ON input signal to the logic gate 47. The effective range 53 of the transmitter system 19 and long distance receiver 45 is greater than the effective range 55 of the transmitter system 19 and the short distance receiver 46.

In operation the operator enters the vehicle 32, while the vehicle 32 is in the garage 11. The operator momentarily closes the spring loaded switch 40, which causes the remote transmitter 41 to generate and transmit an electromagnetic signal, which is received by the opener receiver 14, which sends a signal to the garage door opener 12 to open the garage door 10. The open garage door 10 causes the sensor 16 to send a signal, which causes the long distance transmitter 20 and the short distance transmitter 22 to transmit the first signal and the second signal. The long distance receiver 45 receives the first signal from the long distance transmitter 20, and provides an ON input to the logic gate 47. The short distance receiver 46 receives the second signal from the short distance transmitter 22, and provides an ON input to the logic device 47. The NOT gate 49 receives an ON signal from the short distance receiver 46 and inverts the ON signal to an OFF input and then the AND gate 50 AND's the OFF input with the ON signal from the long distance receiver 45 resulting in an OFF signal, and therefore no alarm signal is generated by the alarm system 48.

The vehicle 32 exits the garage 11 and for a short distance the garage door 11 remains open. The open garage door 10 causes the sensor 16 to send a signal, which causes the long distance transmitter 20 and the short distance transmitter 22 to transmit the first signal and the second signal. The long distance receiver 45 receives the first signal from the long distance transmitter 20, and provides an ON input to the logic gate 47. Within the effective range 55 of the transmitter system 19 and the short distance receiver 46, the short distance receiver 46 receives the second signal from the short distance transmitter 22, and provides a ON input to the logic device 47. The NOT gate 49 inverts the ON signal from the short distance receiver 46 to an OFF input and then the AND gate 50 AND's the OFF input with the ON signal from the long distance receiver 45 resulting in an OFF signal, and therefore no alarm signal is generated by the alarm system 48. The effective range 55 of the transmitter system 19 and the short distance receiver 46 is desirable, since it gives the operator time to remember to close the garage door 10, without sounding an alarm signal, since frequent sounding of the alarm will cause the operator to ignore the alarm.

In normal operation, within the effective range 55 of the transmitter system 19 and the short distance receiver 46, the operator momentarily closes the spring loaded switch 40, which causes the remote transmitter 41 to generate and transmit an electromagnetic signal, which is received by the opener receiver 14, which sends a signal to the garage door opener 12 to close the garage door 10, and which closes the garage door 10. The closed garage door 10, causes the sensor 16 to send a signal to the long distance transmitter 20 and the short distance transmitter 22, which causes the long distance transmitter 20 and the short distance transmitter 22 to cease transmission the first signal and the second signal. The long distance receiver 45 stops receiving the first signal from the long distance transmitter 20, providing an OFF input to the logic gate 47. The short distance receiver 46 stops receiving the second signal from the short distance transmitter 22, providing an OFF input to the logic device 47. The NOT gate 49 inverts the OFF input from the short distance receiver 46 to an ON input and then the AND gate 50 AND's the ON input with the OFF input from the long distance receiver 45 resulting in an OFF signal, and therefore no alarm signal is generated by the alarm system 48.

The operator may forget to momentarily close the spring loaded switch 40, thus leaving the garage door 10 open when the vehicle leaves the effective range 55 of the transmitter system 19 and the short distance receiver 46, or a safety device or a malfunctioning garage door may cause the garage door not to completely close. The open garage door 10 causes the sensor 16 to send a signal, which causes the long distance transmitter 20 and the short distance transmitter 22 to transmit the first signal and the second signal. While the vehicle 32 is within the effective range 53 of the transmitter system 19 and the long distance receiver 45, the long distance receiver 45 receives the first signal from the long distance transmitter 20, and provides an ON input to the logic gate 47. Since the vehicle is outside of the effective range 55 of the transmitter system 19 and the short distance receiver 46, the short distance receiver 46 stops receiving the second signal from the short distance transmitter 22, and the short distance receiver 46 provides an OFF input to the logic device 47. The NOT gate 49 inverts the OFF input from the short distance receiver 46 to an ON input and then the AND gate 50 AND's the ON input with the ON input from the long distance receiver 45 resulting in an ON signal, which is sent to the alarm system 48, causing generation of an alarm signal such as a sound.

When the operator is thus notified that the garage door is still open, in some cases the operator may want to leave the garage door open, such as when the operator's children want to bicycle in and out of the garage. The operator, does not need to turn off the alarm or disconnect the alarm. As the operator continues to drive the vehicle, the vehicle will go beyond the effective range 53 of the transmitter system 19 and the long distance receiver 45, so that the long distance receiver 45 stops receiving the first signal from the long distance transmitter 20, and provides an OFF input to the logic gate 47. Since the vehicle is also past the effective range 55 of the transmitter system 19 and the short distance receiver 46, the short distance receiver 46 does not receive the second signal from the short distance transmitter 22, providing an OFF input to the logic device 47. The NOT gate 49 inverts the OFF input from the short distance receiver 46 to an ON input and then the AND gate 50 AND's the ON input with the OFF input from the long distance receiver 45 resulting in an OFF signal, which is sent to the alarm system 48, which stops the alarm signal. Since the alarm system is off, the operator does not need to ignore the alarm signal after the operator has left the effective range 53 of the transmitter system 19 and long distance receiver.

Upon returning home, the vehicle must be within the effective range 55 of the transmitter system 19 and the short distance receiver 46 before the remote transmitter 41 is able to signal the opener receiver 14 to open the garage door, since the effective range 67 between the remote transmitter 41 and the opener receiver 14 is, in the preferred embodiment, less than the effective range 55 of the transmitter system 19 and the short distance receiver 46, as shown in FIG. 3. Within the effective range 55 of the transmitter system 19 and the short distance receiver 46, the operator momentarily closes the spring loaded switch 40, which causes the remote transmitter 41 to generate and transmit an electromagnetic signal, which is received by the opener receiver 14, which sends a signal to the garage door opener 12 to open the garage door 10, and which opens the garage door 10. The open garage door 10, causes the sensor 16 to send a signal to the long distance transmitter 20 and the short distance transmitter 22, which causes the long distance transmitter 20 and the short distance transmitter 22 to transmit the first signal and the second signal. The long distance receiver 45 receives the first signal from the long distance transmitter 20, providing an ON input to the logic gate 47. The short distance receiver 46 receives the second signal from the short distance transmitter 22, providing an ON input to the logic device 47. The NOT gate 49 inverts the ON input from the short distance receiver 46 to an OFF input and then the AND gate 50 AND's the OFF input with the ON input from the long distance receiver 45 resulting in an OFF signal, and therefore no alarm signal is generated from the alarm system 48. Therefore the operator does not need to ignore the alarm signal when the operator opens the garage door in this situation. In other embodiments the effective range 67 between the remote transmitter 41 and the opener receiver 14 is greater than the effective range 55 of the transmitter system 19 and the short distance receiver 46, to allow the operator to close the garage door if the alarm sounds. In this alternative embodiment, it would be desirable to be able to close the garage door but not open it beyond the effective range 55 of the transmitter system 19 and the short distance receiver 46.

In the preferred embodiment the effective range 53 of the transmitter system 19 and the long distance receiver 45 is in the range of 25 yards to 1,000 yards. More preferably the effective range 53 of the transmitter system 19 and the long distance receiver 45 is in the range of 50 yards to 500 yards. In the preferred embodiment the effective range 55 of the transmitter system 19 and the short distance receiver 46 is in the range of 5 yards to 100 yards. More preferably the effective range 55 of the transmitter system 19 and the short distance receiver 46 is in the range of 10 yards to 50 yards. Preferably the difference between the effective range 53 of the transmitter system 19 and the long distance receiver 45 and the effective range 55 of the transmitter system 19 and the short distance receiver 46 is in the range of 5 to 1,000 yards. More preferably the difference between the effective range 53 of the transmitter system 19 and the long distance receiver 45 and the effective range 55 of the transmitter system 19 and the short distance receiver 46 is in the range of 10 to 500 yards.

These embodiments therefore provide a means of generating an alarm signal if the door is open only if the vehicle is less than a first distance, where the alarm is shut off after the vehicle is closer than a second distance.

Figure 4:
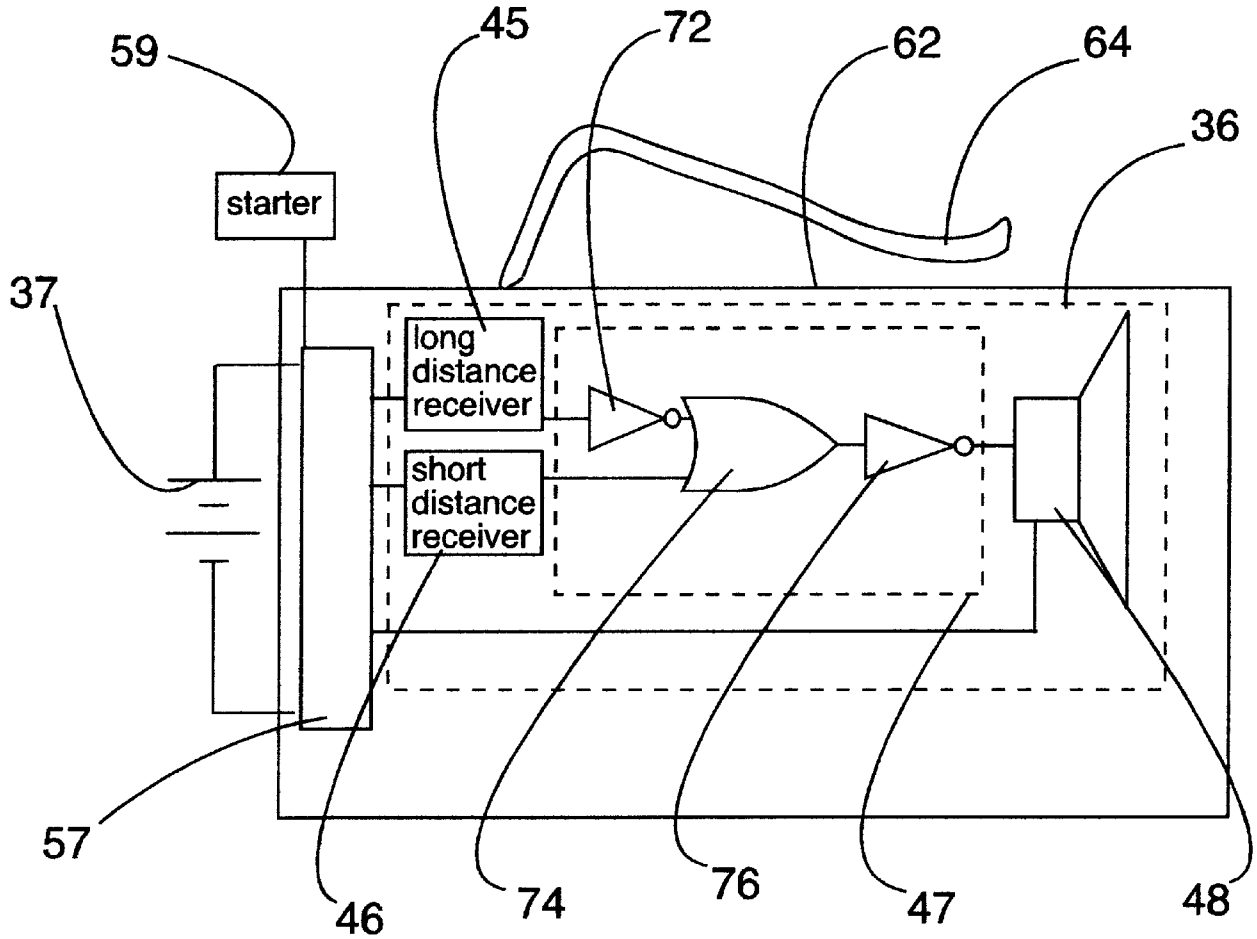
FIG. 4 is an electrical schematic of another embodiment of a receiver.

In another embodiment of the controller circuit has a separate power system than the indicator circuit 36. In such an embodiment, the indicator circuit 36 may be powered by the battery of the vehicle. FIG. 4 illustrates an indicator circuit 36 which is connected to a battery 37 through a timer 57. The battery 37 may also be connected to a controller circuit or may be the vehicle 32 battery, or may be a battery solely dedicated to the indicator circuit 36. The timer 57 is electrically connected to the battery 37 and receives an input from a starter 59 system of the vehicle 32. The timer 57 is electrically connected to a long distance receiver 45 and a short distance receiver 46 of the indicator circuit 36. The long distance receiver 45 and the short distance receiver 46 are electrically connected to inputs of a logic device 47. The logic device 47 provides input to an alarm system 48. The logic device 47 comprises a first NOT gate 72, where the output of the long distance receiver 45 is the input of the first NOT gate 72, an OR gate 74, where outputs of the first NOT gate 72 and the short distance receiver 46 are inputs of the OR gate 74, and a second NOT gate 76, where the output of the OR gate 74 is the input of the second NOT gate 76 and where the output of the second NOT gate 76 is the input of the alarm system 48.

In operation, the indicator circuit 36 works in a manner similar to the previous embodiment. However, the timer 57 is turned on when the vehicle is started and then shuts off a set time after the vehicle starter system 59 is used. Such a timer 57 saves power by disconnecting the power to the long distance 45 and the short distance receiver 46 after a specified time. However, such timers 57 are based on a presumption that the vehicle will be farther than a certain distance within the set time. Such timers may cause errors if a vehicle is allowed to idle before it is driven away. Depending on the usage, such timers may be more or less desirable. In this embodiment, the indicator circuit 36 is housed in a housing 62 with a clip 64 to provide a means for mounting the housing in a vehicle.

This embodiment therefore generates an alarm signal when the door is open only if the vehicle is closer than a first distance and further than a second distance and where the alarm signal is shut off after a period of time.

The logic device may be a semiconductor chip or a wiring path or a switching mechanism or other circuitry. In the preferred embodiment the logic device is a NOT gate and an AND gate, however, the receivers and alarm and timer may be wired in other ways as illustrated in the previous example allowing for other logic devices that produce the same result of providing an alarm that shuts off within or outside of certain distances.

Figure 5:
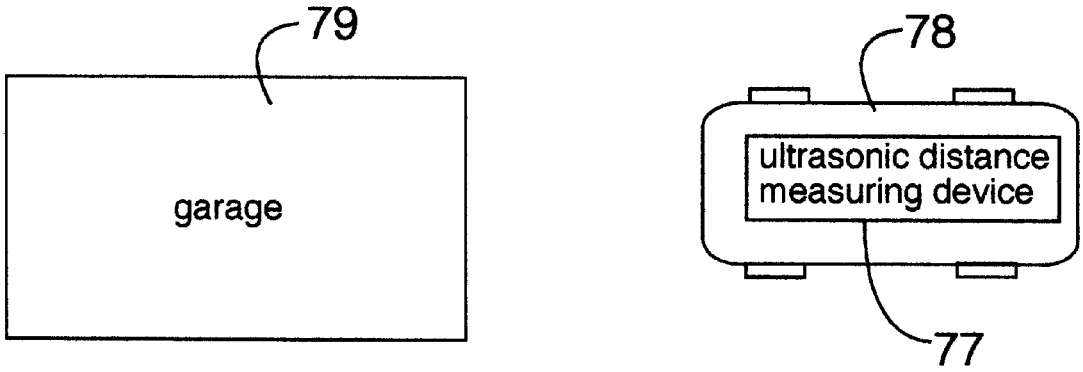
FIG. 5 is a schematic view of another embodiment of the invention.

Other embodiments would replace the short distance receiver with a distance measuring device such as an ultrasonic distance measuring device 77 mounted on a vehicle 78, which measures the distance of the vehicle 78 from a garage 79, as shown in FIG. 5. A logic device links the long distance receiver to the distance measuring device 77, so that an alarm system generates an alarm signal only if a sensor indicates that the door is open and if the vehicle is further than a second distance measured by the distance measuring device 77, but shuts off the alarm signal after the vehicle is further than a first distance measured by the distance measuring device 77, or past the effective range of a transmitter and the long distance receiver The alarm signal from the alarm system could be something other than a sound generator, such as a flashing light.

In another embodiment of the invention, the transmitter system may only comprise a single transmitter, where both the long distance receiver and the short distance receiver are tuned to the same signal from the single transmitter, but where the effective range between the transmitter system and the long distance receiver still has a greater effective range between the transmitter system and the short distance receiver.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims.

I claim:

1. A warning apparatus, comprising:

a sensor;

a transmitter system which transmits at least one signal electrically connected to the sensor; and an indicator circuit, comprising:

an alarm system that provides an alarm signal;

a first receiver, which is tuned to a first signal of the at least one signal from the transmitter system, wherein the first receiver is able to receive the first signal from the transmitter system up to a first effective range;

a logic device which receives input from the first receiver and provides output to the alarm system, wherein the logic device signals the alarm system to generate an alarm, only when the first receiver receives the first signal from the transmitter system and the indicator circuit is closer to the transmitter system than a first distance and further from the transmitter system than a second distance.

2. The warning apparatus, as recited in claim 1, further comprising:

a second receiver, which is tuned to a second signal of the at least one signal from the transmitter system, and which provides input to the logic device and wherein the second receiver is able to receive the second signal from the transmitter system up to a second effective range, and wherein the first distance is the first effective range and the second distance is the second effective range.

3. The warning apparatus, as recited in claim 2, wherein there is a difference between the first effective range and the second effective range, and wherein the difference between the first effective range and the second effective range is between 5 and 1,000 yards, and wherein the first effective range is greater than the second effective range.

4. The warning apparatus, as recited in claim 3, further comprising:

a door;

a door opener mechanically connected to the door; and a opener receiver, which controls the door opener, wherein the sensor is able to sense whether or not the door is closed.

5. The warning apparatus, as recited in claim 4, further comprising a controller circuit, comprising:

a switch; and a remote transmitter electrically connected to the switch, wherein the opener receiver is tuned to a signal generated by the remote transmitter.

6. The warning apparatus, as recited in claim 5, wherein the logic device comprises:

a NOT gate; and an AND gate which receives input from the NOT gate.

7. The warning apparatus, as recited in claim 6, wherein the difference between the first effective range and the second effective range is between 10 and 500 yards.

8. The warning apparatus, as recited in claim 7, wherein the first receiver provides an output which is sent to the AND gate, and wherein the second receiver provides an output which is sent as input to the NOT gate.

9. The warning apparatus, as recited in claim 8, further comprising a means for mounting the indicator circuit in a vehicle.

10. The warning apparatus, as recited in claim 9, wherein the indicator circuit is electrically connected to the controller circuit.

11. The warning apparatus, as recited in claim 9, wherein the indicator apparatus is electrically connected to a vehicle.

12. The warning apparatus, as recited in claim 9, wherein the first signal is the same as the second signal.

13. The warning apparatus, as recited in claim 9, wherein the transmitter system comprises:

a first transmitter for generating the first signal with a first frequency; and a second transmitter for generating the second signal with a second frequency, wherein the first frequency is different than the second frequency.

14. The warning apparatus, as recited in claim 5, wherein the remote transmitter and opener receiver have an effective range which is less than the second effective range.

15. The warning apparatus, as recited in claim 2, wherein the logic device, comprises:

a NOT gate; and an AND gate that receives input from the NOT gate, wherein the second receiver provides an output which is sent to the NOT gate, and wherein the first receiver provides an output which is sent as input to the AND gate with output from the NOT gate.

16. The warning apparatus, as recited in claim 3, wherein the transmitter system comprises:

a first transmitter for generating the first signal with a first frequency; and a second transmitter for generating the second signal with a second frequency, wherein the first frequency is different than the second frequency.

17. A method of providing a warning alarm for whether a door is closed from a vehicle remotely located from the door, comprising the steps of:

sensing if a door is not closed;

determining if the vehicle is closer than a first distance;

determining if the vehicle is further than a second distance;

providing an alarm only if the door is not closed and the vehicle is closer than the first distance and further than the second distance.

18. A warning apparatus for a door, comprising:

a sensor for determining if the door is open;

a vehicle; and means for generating an alarm signal only if the door is open and the vehicle is closer to the door than a first distance and further from the door than a second distance.

* * * * *